United States Patent [19]

Neale, Sr.

[11] 4,136,441

[45] Jan. 30, 1979

[54] APPARATUS AND METHOD FOR BUTT SPLICING WIRES

[75] Inventor: Dory J. Neale, Sr., Topeka, Kans.

[73] Assignee: The National Telephone Supply Company, Cleveland, Ohio

[21] Appl. No.: 814,532

[22] Filed: Jul. 11, 1977

[51] Int. Cl.[2] ..... H01R 43/04

[52] U.S. Cl. ..... 29/628; 29/630 F; 29/753

[58] Field of Search ..... 29/514, 628, 630 F, 29/748, 753, 757, 751, 566.3, 566.4

[56] References Cited

U.S. PATENT DOCUMENTS

| | | | |
|---|---|---|---|
| 3,529,342 | 9/1970 | Burgess et al. | 29/753 |
| 3,593,403 | 7/1971 | Gurley | 29/757 |
| 3,594,900 | 7/1971 | Dola | 29/628 |
| 3,708,878 | 1/1973 | Mann, Sr. et al. | 29/630 F |
| 3,886,642 | 6/1975 | Neale, Sr. | 29/630 F |

*Primary Examiner*—Michael J. Keenan
*Attorney, Agent, or Firm*—Fishburn, Gold & Litman

[57] ABSTRACT

An apparatus and method for butt splicing a pair of insulated electrical conductors by crimping an open-sided sleeve thereon. The apparatus comprises a frame, a wire cutter, a pair of laterally acting crimping jaws, a wire tensioning assembly, a sleeve feed assembly, a sleeve ejector, and a power cylinder, all of which are operably interconnected for sequential splicing operation. A connector sleeve is initially severed from a continuous chain thereof and is automatically positioned in each of the crimping jaw sets by the sleeve feed assembly. A pair of matching wires is then selected and pulled taut in a side-by-side manner, between the opposing side walls of each of the sleeves. Next, the power cylinder is actuated and in seriatim, the ends of the wires are trimmed to length by the cutters; the crimping jaws with sleeves retained therein are translated longitudinally of, and with respect to the wires, such that the trimmed wire ends are disposed wholly within the sleeve; the wire tensioning assembly places slack in each of the wire pairs; the crimping jaws are converged and securely crimp the sleeves onto the wires; the ejectors remove the crimped sleeves and spliced wires from the jaws; and another sleeve is automatically fed into each crimping jaw by the sleeve feed assembly.

24 Claims, 21 Drawing Figures

Fig. 1.
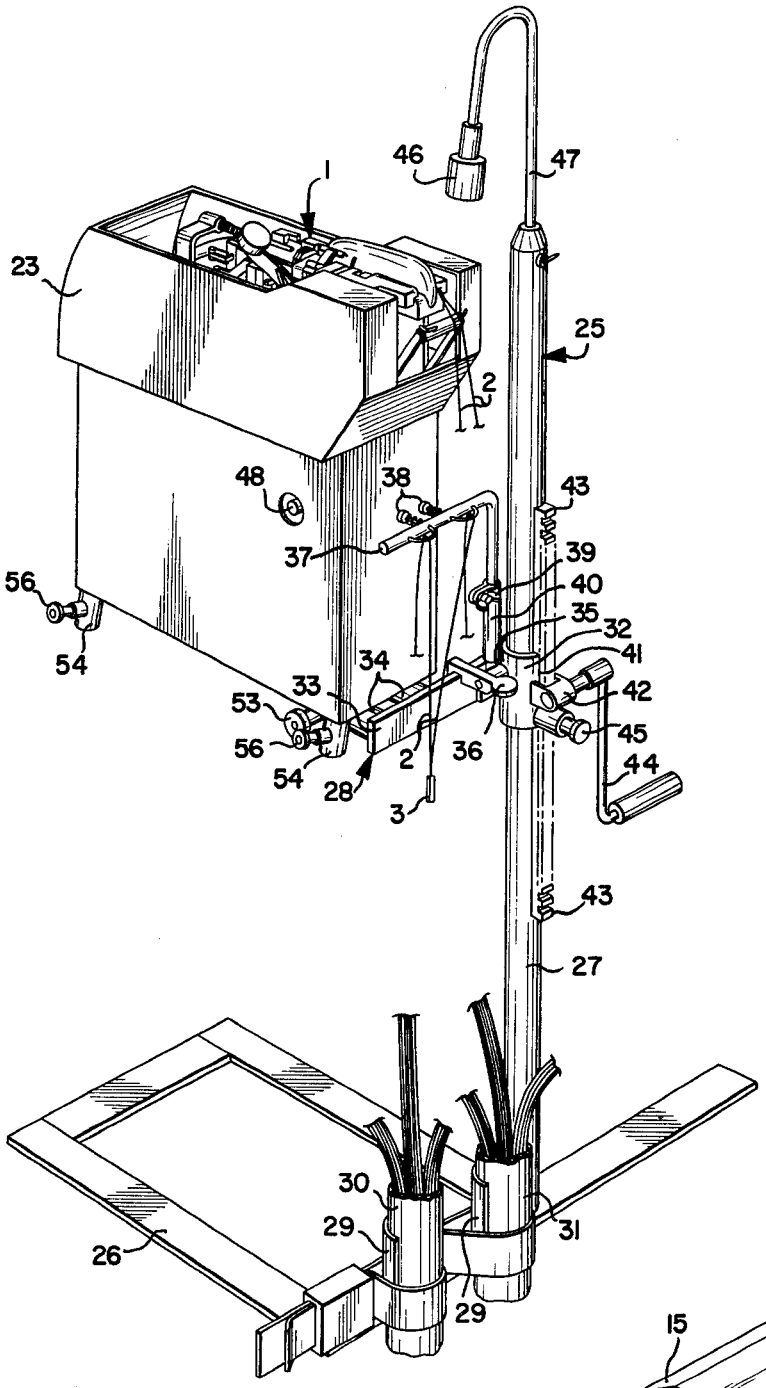
Fig. 2.
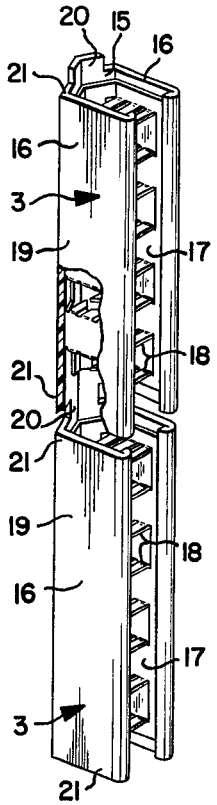
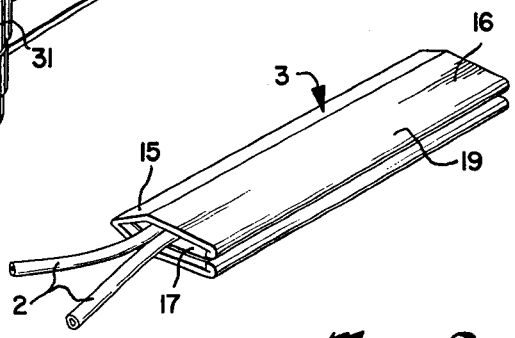
Fig. 3.

1
247
114
7
5
103
192
166
159
9
173
164
165
222
281
224
244
230
162
178
185
274
227
243
273
266
239
115
260
195
257
274
242
202
259
182
8
220
198
271
261
256
241
203
275
64
276
258
64
245
216
196
272
240
217
66
277
219
48
10
4
218
51
61
57
50
56
54
55
49
53
52
54
55
56
54
55

166
159
164
105
103
1
9
165
192
104
123
103
5
114
282
162
264
81
7
50
225
274
185
113
221
247
178
6
280
8
224
115
182
279
225
222
198
271
264
276
254
148
263
220
4
265
145
149
146
147
269
268
266
216
51
219
219
218

Fig. 6.
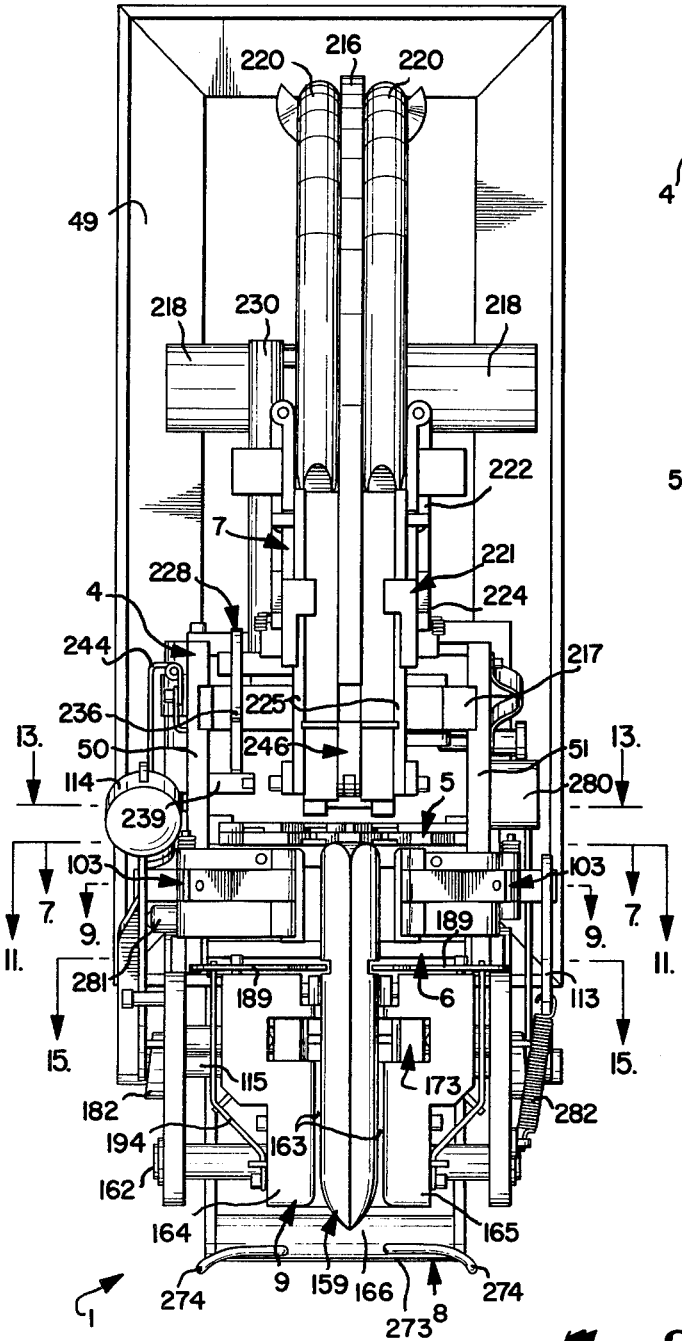
Fig. 7.
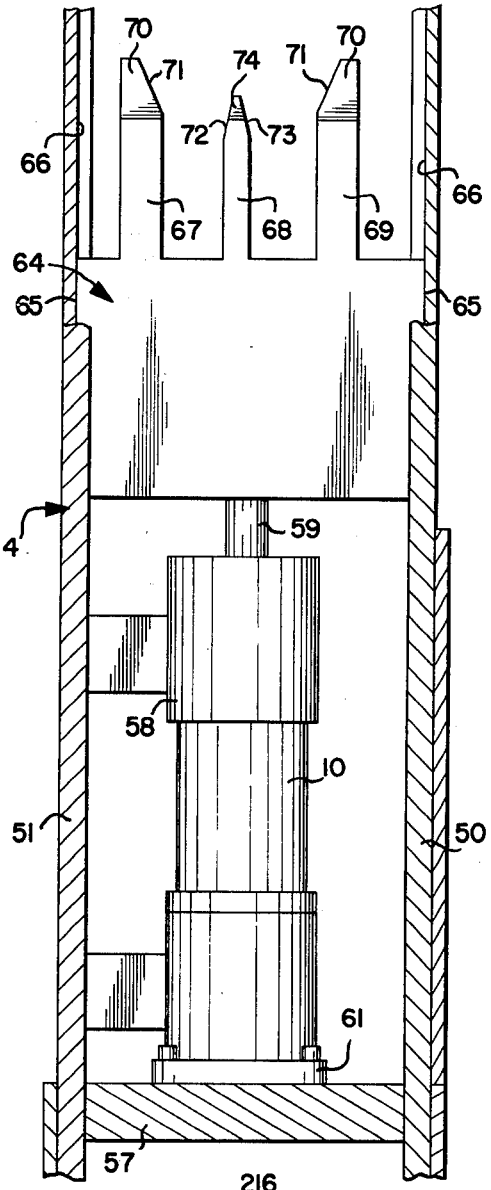
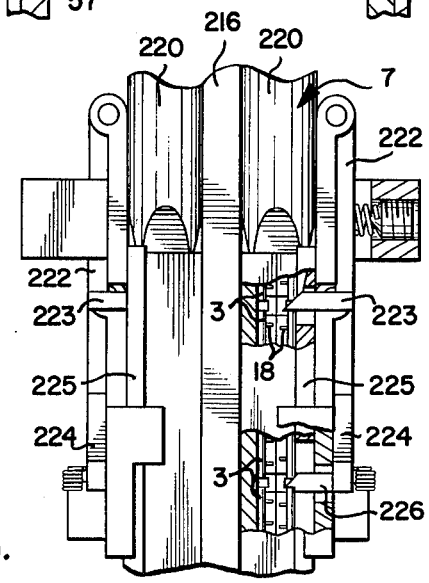
Fig. 8.

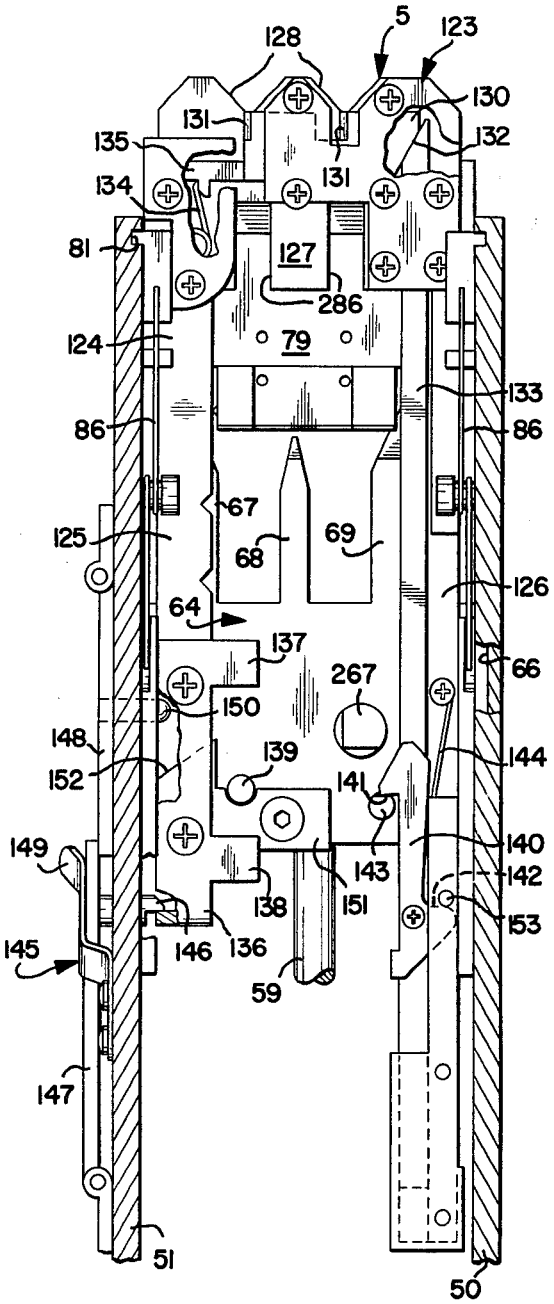
Fig. 13.
Fig. 14.
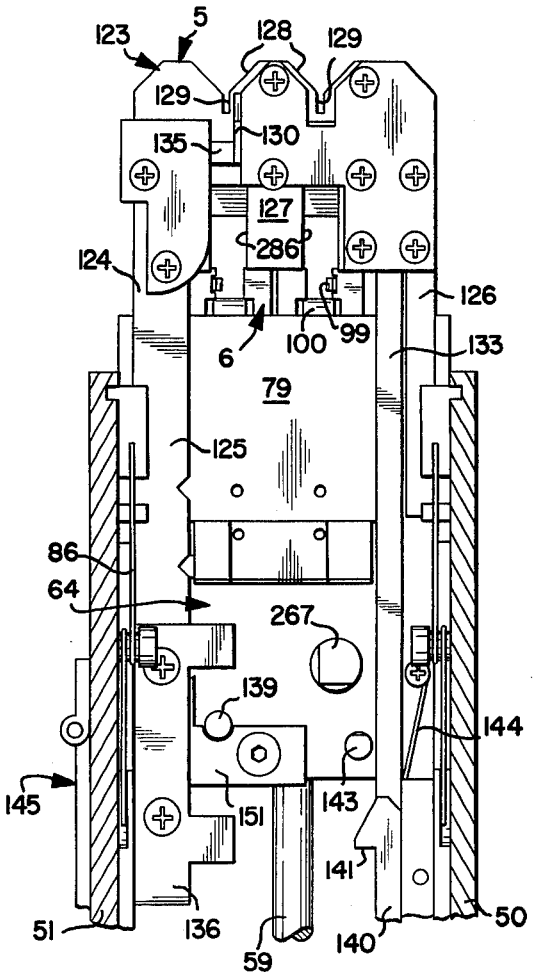

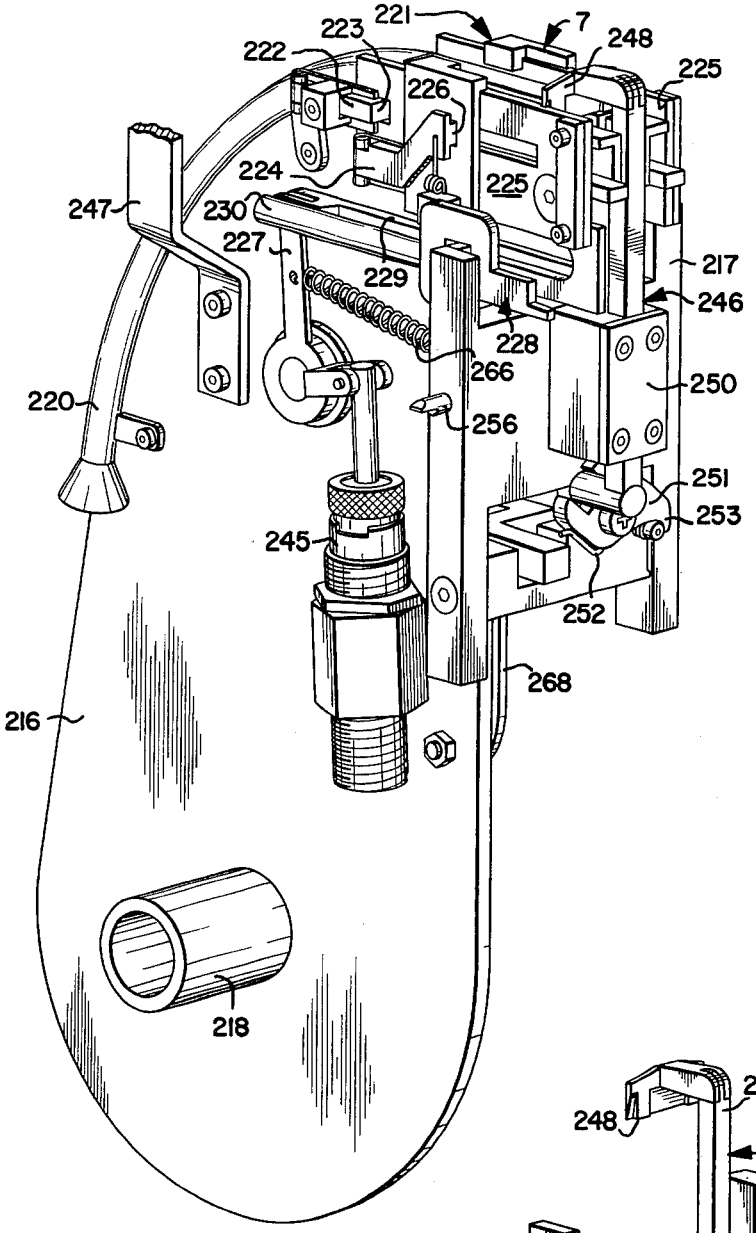
Fig. 20.
Fig. 21.
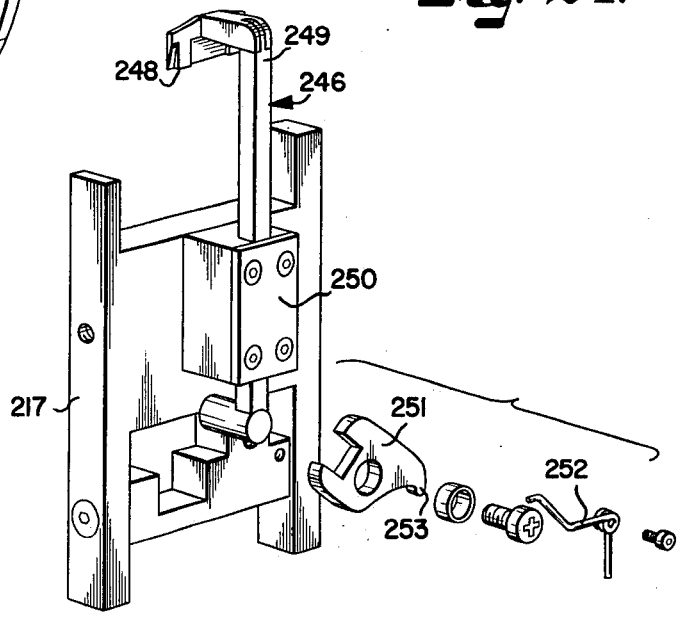

APPARATUS AND METHOD FOR BUTT SPLICING WIRES

In the telephone industry, it is often necessary to electrically connect or splice two or more telephone cable segments together, each of which may include several hundred individual wires. When the splice is to be positioned perpendicularly to the elongate cable segments, such as when the cable is buried under the ground and the connection is made in an above ground, vertically positioned enclosure or pedestal, the wires must be butt spliced together, whereby the free end of each wire is disposed adjacent to the other and the same are electrically joined in a side-by-side fashion near the ends thereof. The splicing operation is typically performed at a field location, and must provide adequate and reliable electrical continuity in the splice, as well as being easy and efficient. Also, each of the spliced wires must be insulated from the others to prevent shorting thereacross and consequent service interruptions. Although there are several prior art devices for splicing electrical connectors by crimping an open-sided sleeve thereon, such as U.S. Pat. No. 3,886,642 issued in 1975 to Neale, such devices are not adapted for butt splicing.

This invention relates to a device and method for electrically connecting multi-wire cables, and in particular, to a butt splicer for telephone cables.

The principal objects of the present invention are: to provide an apparatus and method for trimming the end portions of a pair of wires and butt splicing the same together by crimping an open-sided electrical connector sleeve thereon; to provide such an apparatus having means to position the trimmed ends of the wires wholly within the connector sleeve to insure electrical insulative integrity; to provide such an apparatus having automatic ejector means for removing the spliced wires and sleeve from the crimping jaws to improve splicing efficiency; to provide such an apparatus having injector means for automatically inserting connector sleeves into the crimping means for quick operation; to provide such an apparatus wherein the injector means includes a device for severing a leading connector sleeve from a continuous chain thereof for speedy, continuous splicing operation; to provide such an apparatus having a sliding cam engaging the crimping jaws and converging jaw portions thereof, as well as longitudinally translating the same for high speed and efficient splicing; to provide such an apparatus which is operative to simultaneously splice two pairs of wires by crimping a pair of connector sleeves onto respective wire pairs; to provide such an apparatus which is automatic in operation and requires minimal hand work by the operator; to provide such an apparatus which effects uniform splicing of the wires by consistent crimping of the connector sleeves onto the wires; to provide such an apparatus having a housing and guard means for safe and trouble-free operation; to provide such an apparatus having an adjustable stand with illumination means for convenient operation; to provide such an apparatus which is compact and portable and usable at field locations for splicing multiple wire cables; and to provide such an apparatus which is economical to manufacture, efficient in use, capable of a long operating life, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include exemplary embodiments of the present invention and illustrate various objects and features thereof.

FIG. 1 is a perspective view of a butt splicing apparatus for wires embodying the present invention, and an adjustable stand therefor.

FIG. 2 is an enlarged perspective view of a pair of joined connector sleeves in an uncrimped condition.

FIG. 3 is an enlarged perspective view of a connector sleeve with a pair of wires crimped therein.

FIG. 6 is a top plan view of the apparatus.

FIG. 7 is a fragmentary vertical cross-sectional view of the apparatus taken along the line 7—7, FIG. 6, and particularly showing a sliding cam and power cylinder.

FIG. 8 is an enlarged, fragmentary top plan vieW of a portion of the sleeve feed assembly with portions broken away to show pawl members engaging a sleeve chain.

FIG. 13 is a fragmentary vertical cross-sectional view of the apparatus taken along the line 13—13, FIG. 6, and particularly showing a wire cutter assembly.

FIG. 14 is a view similar to FIG. 13 showing the wire cutter assembly in a raised position.

FIG. 20 is a perspective view of an automatic sleeve feed assembly of the butt splicing apparatus.

FIG. 21 is an exploded perspective view of a sleeve cutting mechanism of the automatic feed assembly Referring more in detail to the drawings:

Figure 4:
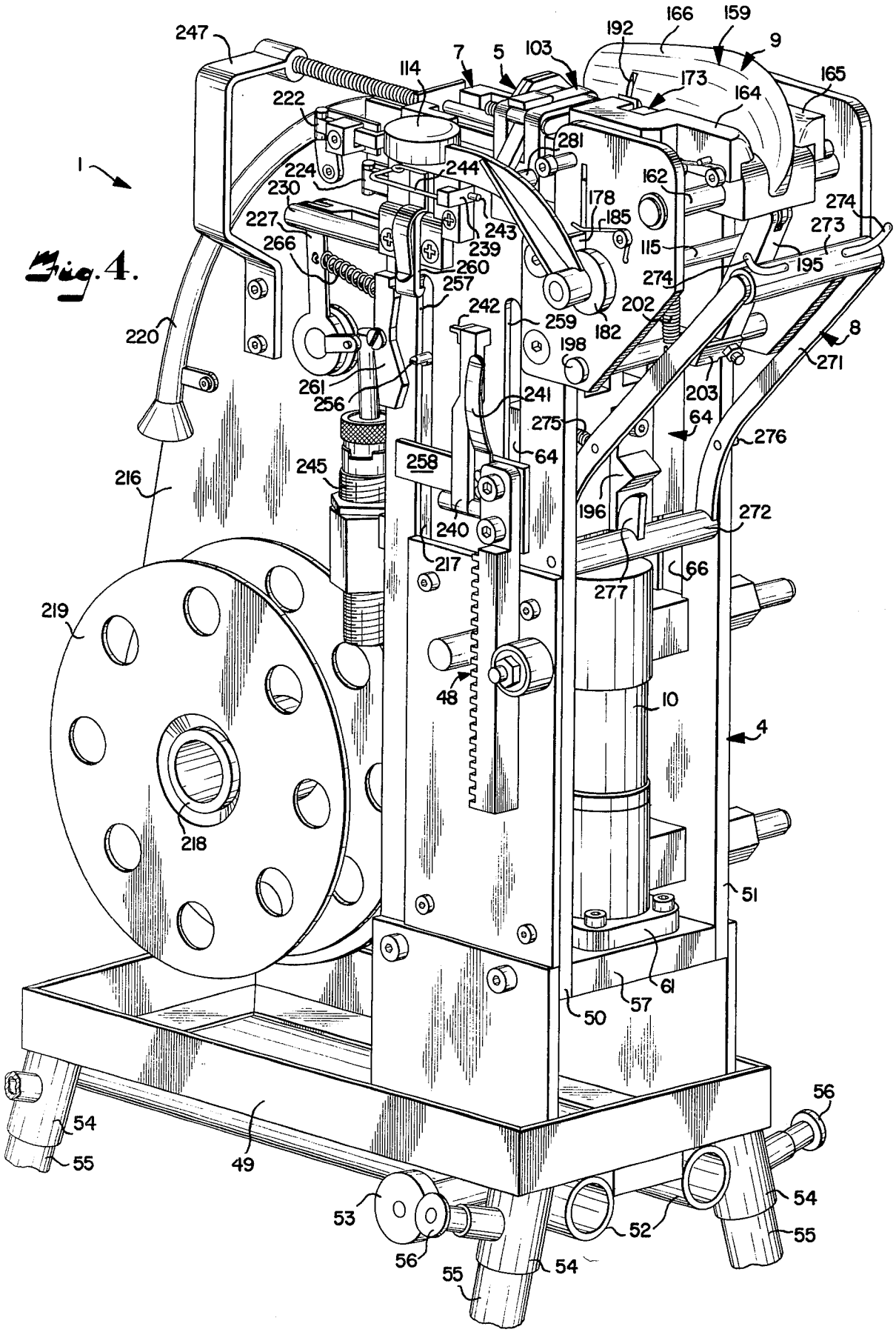
FIG. 4 is a perspective view of the butt splicing apparatus taken from a left side thereof.

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates an apparatus embodying the present invention for butt splicing two or more insulated electrical conductors 2 together by crimping an open-sided sleeve 3 thereon. The apparatus 1 comprises a frame 4, a pair of wire cutters 5, laterally acting jaw 6, a sleeve feed assembly 7, a wire tensioning arm 8, a sleeve ejector assembly 9, and a power cylinder 10, all of which are operably interconnected for sequential splicing operation.

The connector or sleeve 3 (FIG. 2) is of the channel-shaped type, such as that disclosed in U.S. Pat. Nos. 3,814,836 and 3,886,646, issued to Neale, having a web 15 with opposed spaced apart side walls 16 extending therefrom, and including an electrically conductive inner portion 17 with rows of conductor engaging protuberances 18, and an electrically insulative outer portion 19. The sleeves are preferably formed in an elongate strip or chain having a small tab portion 20 extending longitudinally from the end 21 of each connector 3 and joining the outer portions 19 of adjacent sleeve members in an end-to-end manner.

The butt splicer 1 is preferably supported by a stand 25 (FIG. 1) which is vertically adjustable to accomodate various splicing requirements. The illustrated stand 25 comprises a base 26, an upstanding column 27, and a bracket 28 connected therewith, which provides means for removably connecting the butt splicer with the stand. The base 26 includes a pair of clamps 29 for retaining the upstanding cables 30 and 31 to be spliced together. The bracket 28 is slidably connected with the column 27 by a collar 32, and includes a forward plate 33 fixedly attached to the collar, and a fork member 34 rotatably connected with the collar at a pivot joint 35. A latch or clip 36 engages the plate 33 and prevents pivoting of same during operation. A vertically adjustable, telescoping L-shaped bracket 37 is attached to the forward plate 33, and includes a spring loaded J-clamp 38 for connecting the individual wires 2 of the cables to the bracket 37. The illustrated bracket 37 includes a wing nut 39 and split sleeve 40 for vertical adjustment of the bracket 37. The collar 32 has a keyed portion 41 and a pinion 42 mounted therein which meshes with a rack 43 attached to the medial portion of the column 27. A crank arm 44 is connected with the pinion 42 and rotates the same for vertically adjusting the butt splicer. The collar also includes a laterally acting lock or pawl 45 which engages the rack 43 and vertically retains the butt splicer in the selected position. In this example, an illumination device 46 such as an electrical lamp is attached to the uppermost end of the column 27 with an adjustable neck 47 and provides light to facilitate the splicing operation. A sheet metal housing 23 is detachably fastened to the apparatus 1 and covers the sides and ends of the same.

The frame 4 (FIG. 4) comprises a base 49 and a pair of parallel, upstanding side plates 50 and 51 in which the operating members of the butt splicer are mounted. In this example, the base includes a pair of longitudinally disposed tubes 52 attached to the bottom thereof which are adapted to receiving therein the fork-shaped support 34. A lock screw 53 engages the fork 34 and retains the butt splicer on the stand. The base 49 includes depending sleeve members 54 attached to each corner of the base for telescopically receiving optional supporting legs 55. A spring lock device 56 is attached to each sleeve 54 and provides means for detachably connecting the optional support legs 55 therewith. A horizontally positioned support 57 extends between the side plates 50 and 51 and is connected therewith, and provides a base for attaching the power cylinder 10 to the frame 4. A rack, crank pinion, and antifriction bearing assembly 48 is shaped to receive a geared crank arm (not shown) for elevating and lowering the sleeve feed assembly manually and making repairs or adjustments. A shaft portion of the assembly extends outwardly through a mating aperture in the housing 23 and is shaped to engage the crank arm.

The power cylinder 10 (FIG. 7) is of a conventional design having an outer casing 58 with a piston shaft 59 projecting therefrom, and is activated by conventional means, such as air pressure, hydraulics, or the like. The illustrated power cylinder is a double acting, hydraulic cylinder and includes a remotely controllable valve mechanism (not shown) for automatically pressurizing the cylinder at the beginning of the cycle and reversing hydraulic pressure on the cylinder downstroke. The cylinder is positioned between the frame side plates 50 and 51 and has the base 61 thereof attached to the support 57.

The upper end of the piston shaft 59 is attached to a fork-shaped cam 64 (FIG. 7) which is shaped for manipulating the crimping jaws 6. The cam 64 has flat sides 65 and is mounted in grooves or slots 66 which are disposed longitudinally along the interior side of each side plate 50 and 51, whereby activation of the cylinder slides the cam 64 upwardly and downwardly within the frame. The cam 64 includes three projecting prongs 67, 68 and 69 respectively. In the attitude illustrated in FIG. 7, the left and right hand prongs 67 and 69 respectively, each include two inclined surfaces 70 and 71, disposed on adjacent, interior faces of the cam. Inclined surfaces 70 face toward the rear of the device and are shaped to engage a crimping carriage and translate the same horizontally within the frame. The inclined surfaces 71 are opposed and oriented inwardly of the cam, and engage the jaw members of the crimping assembly for closing the jaws and crimping the sleeve onto the wires. The middle prong 68 has three incline surfaces 72, 73, and 74 respectively, the side faces 72 and 73 of which are associated with the incline surfaces 71 of the end prongs and assist in closing the crimping jaws. The remaining face 74 is associated with the incline surfaces 70 of the end prongs and engages the crimping carriage to translate the same within the frame.

Figure 9:
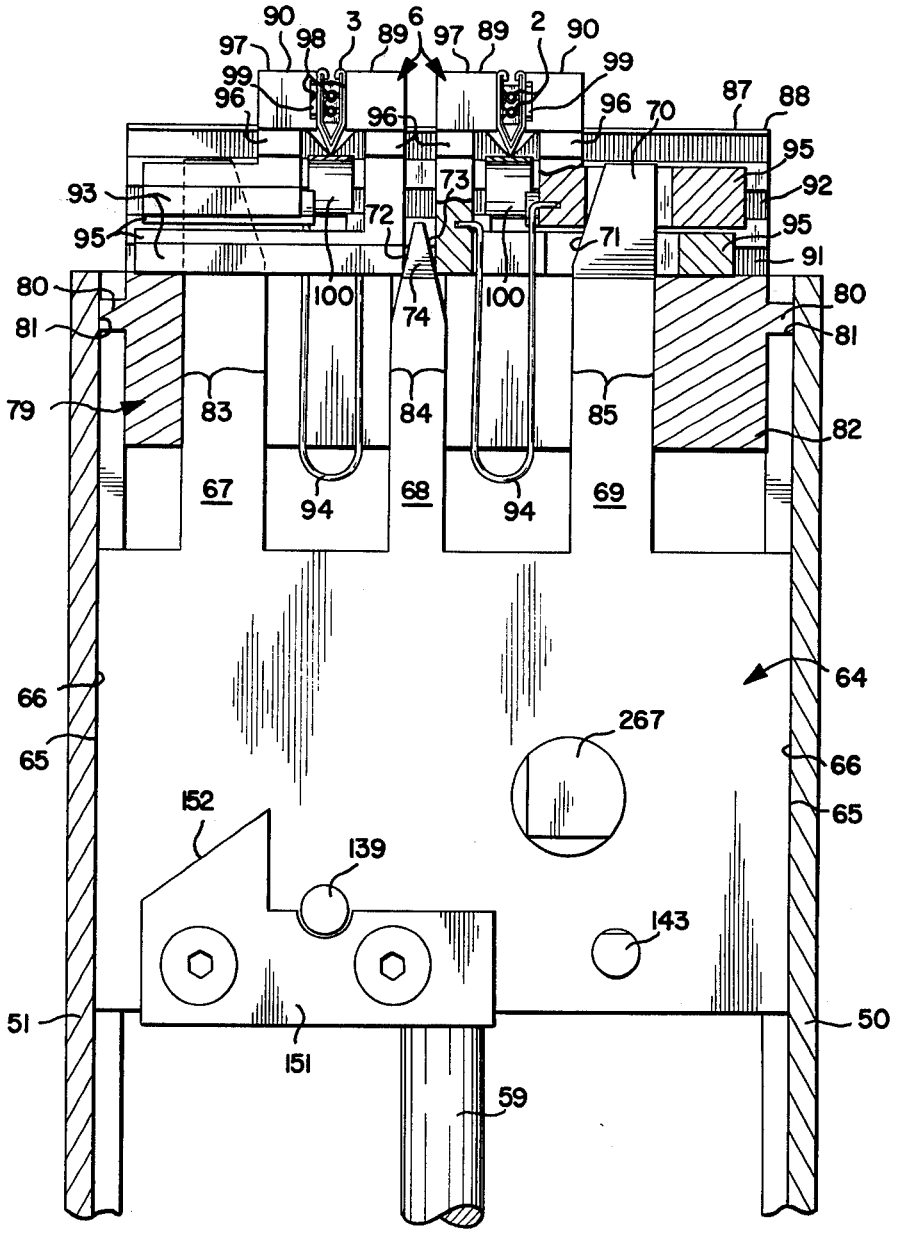
FIG. 9 is an enlarged fragmentary vertical cross-sectional view of the apparatus taken along the line 9—9, FIG. 6, and particularly showing crimping jaw members.
Figure 10:
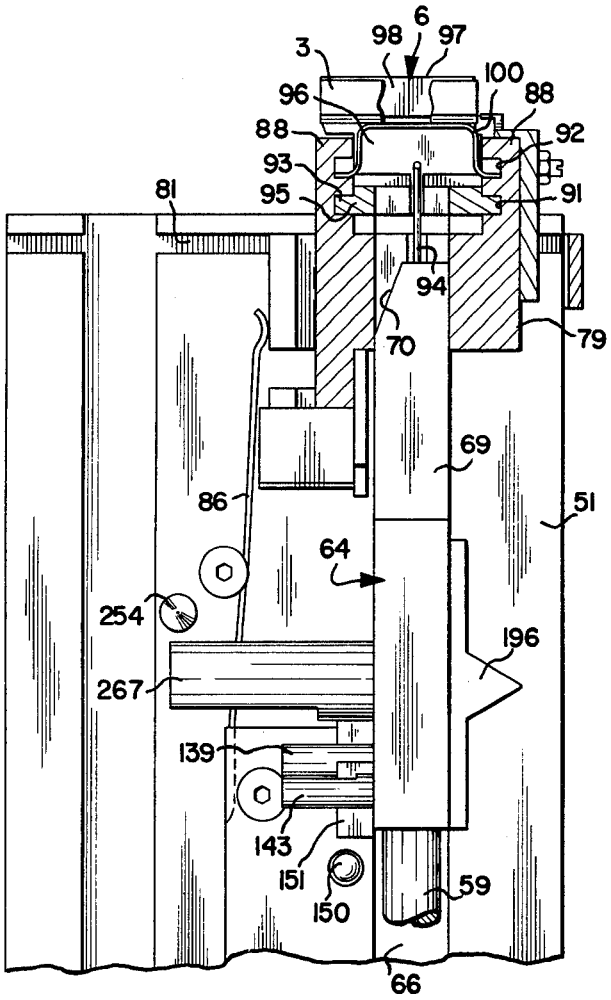
FIG. 10 is a vertical longitudinal cross-sectional view of the crimping jaw members showing the jaw carriage in a rearward position.

The crimping jaw assembly (FIG. 9) comprises the carriage 79 having lateral projections 80 positioned in slots 81 adjacent the upper end of each of the frame side plates 50 and 51, wherein the carriage may be translated forwardly and rearwardly with respect to the frame. The lower portion 82 of the carriage has three vertically disposed apertures 83, 84, and 85 positioned therethrough. The carriage apertures are aligned with and allow the cam prongs 67, 68, and 69 respectively to pass therethrough. The carriage 79 is normally retained in a forwardmost position by resilient means such as a pair of hair springs 86 (FIG. 10). When the cam 64 moves upwardly, inclined faces 70 and 74 impinge upon the side walls which define the associated carriage aperture 83, 84 and 85 respectively, and force the carriage 79 rearwardly along the slides 80 to position the trimmed wire ends wholly within the connector sleeves. On the downstroke, the cam is withdrawn from the carriage apertures and the springs 86 force the same into the normally forwardmost position.

The upper portion 87 (FIG.9) of the carriage 79 includes a pair of opposed, upstanding plates 88 which form a channel in which the inside and outside jaws 89 and 90 respectively, are slidably mounted. In this example, each plate has a pair of longitudinal parallel slots 91 and 92 positioned therein which mate with lateral projections 93 provided on each of the jaws. The inside jaws 89 are mounted in the lower slots 91, and the outside jaws 90 are positioned in the upper slots 92. A hair spring 94 is connected between each pair of inside and outside jaws and urges the same apart to an open or feed position. The jaws 89 and 90 are L-shaped and include a base portion 95 on which projections 93 are disposed, and an upstanding arm portion 96 with the upper ends 97 shaped for abutting contact with the side walls 16 of the connector sleeve 3. The crimping faces 98 of each jaw set are mutually parallel and extend substantially co-extensively along the length of the sleeve disposed thereinbetween. In this example, the crimping face of each of the outside jaws is channeled and a leaf spring 99 is positioned therein which urges the sleeve 3 against the inner jaw 89 in a non-crimped position, and retains the same therein during rearward translation of the carriage 79. A flat spring 100 yieldingly supports the bottom of the sleeve such that as the sleeve is crimped inwardly, the bottom may elongate downwardly against the spring. The base 95 of each of the crimping jaws is apertured to allow the associated outside crimping cam prong 67 and/or 69 to extend therethrough. On the upstroke, the crimping cam prongs 67, 68, and 69 extend through the carriage apertures 83, 84, and 85 respectively, first moving the entire carriage 79 rearwardly. As the cam prongs continue to translate upwardly through the carriage, the outside prongs 67 and 69 extend through the base aperture of the inside jaws 89 and the inclined faces 71 thereof engage an inner marginal edge of the outside jaws 90 and force the same inwardly towards the center of the device. Contemporaneously, the inclined surfaces 72 and 73 of the center crimping cam prong 68 engage the outer end edge of each inside jaw 89 and force them outwardly toward the outside jaws, whereby the connector sleeve 3 positioned thereinbetween is crimped and wires disposed therein are electrically and mechanically connected. On the downstroke, the inclined surfaces of the crimping cam prongs are retracted through the carriage apertures, the same disengage their associated jaw faces, and the hair springs 94 force each pair of the inside and outside jaws divergingly apart.

Figure 5:
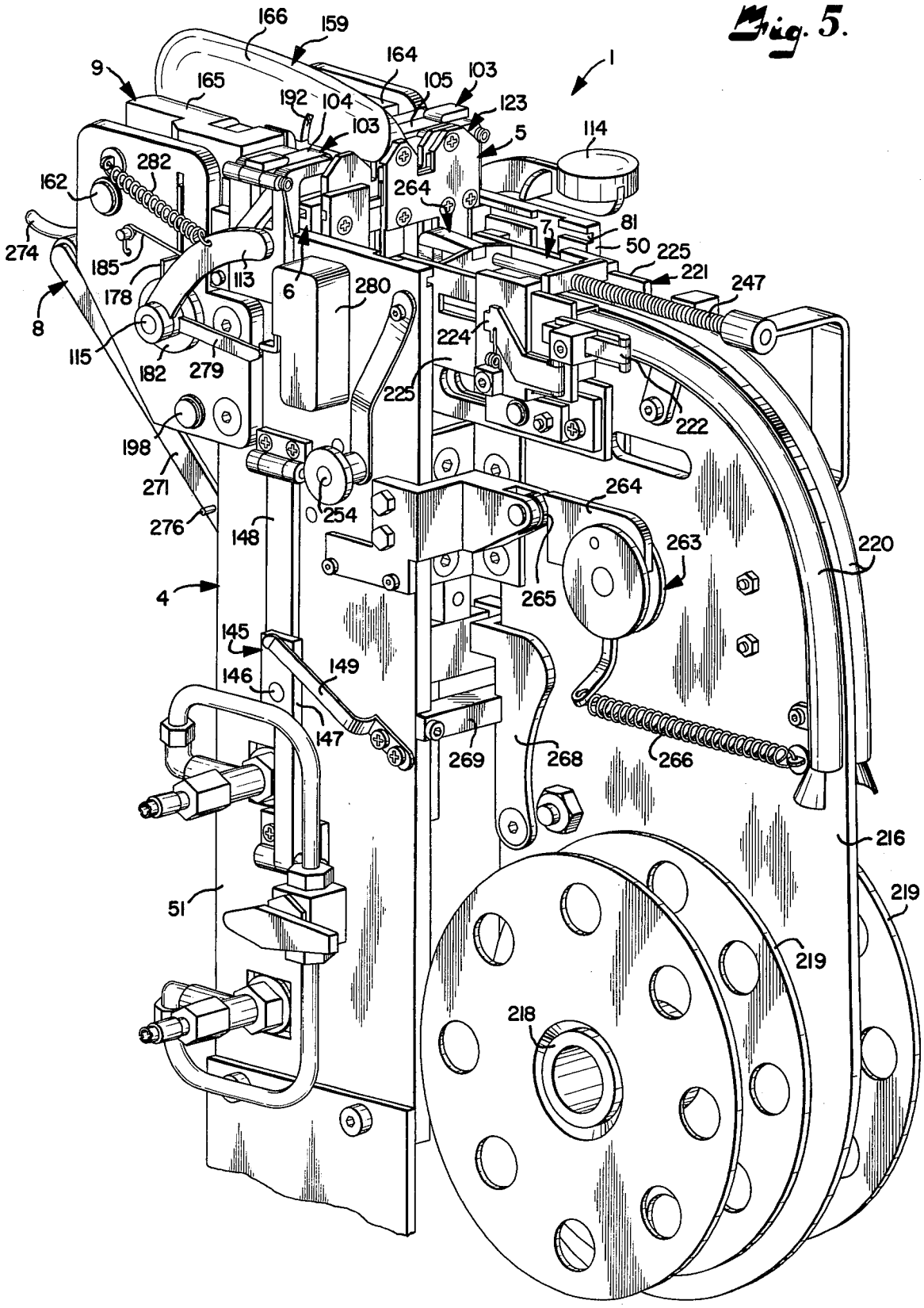
FIG. 5 is a perspective view of the butt splicing apparatus taken from the right side thereof.
Figure 11:
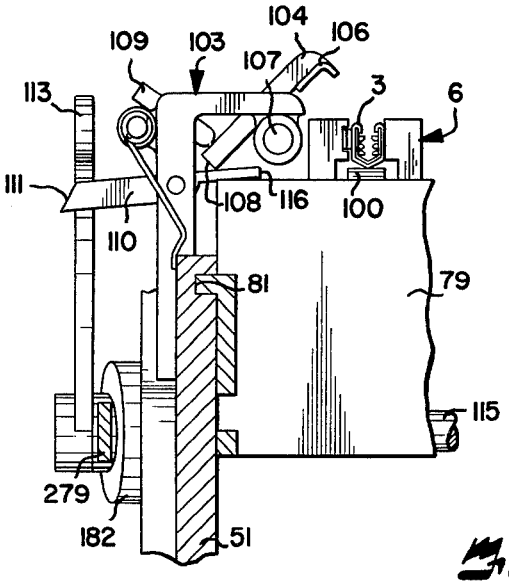
FIG. 11 is a fragmentary vertical cross-sectional view of the apparatus taken along line 11—11, FIG. 6, and particularly showing a wire positioner assembly in an open position.
Figure 12:
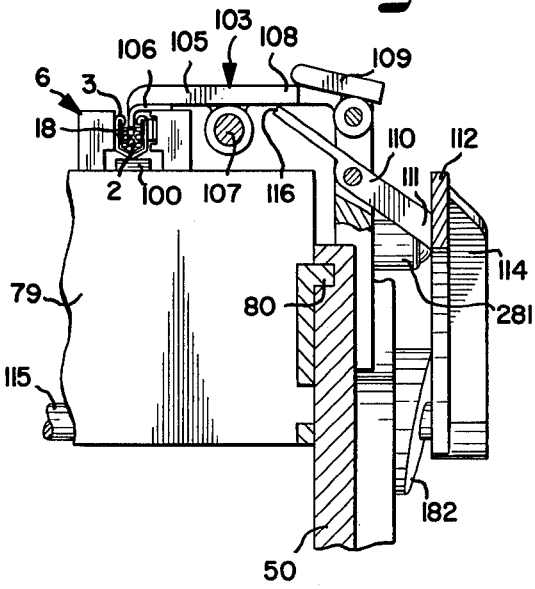
FIG. 12 is a view similar to FIG. 11 showing a wire positioner assembly in a closed position.

The wire positioner assembly 103 is best illustrated in FIGS. 5, 11 and 12, and comprises a pair of hingedly mounted arms 104 and 105, each having an L-shaped positioner tip 106, which, in an operative position, forces the wires 2 downwardly between the teeth or protuberances 18 of the sleeve to assure contact therebetween. In this example, the tip 106 is connected with the innermost end of each arm 104 and 105. The medial portion of the arm is pivotally attached to the frame by a pin 107 and the outer arm end 108 is engaged by a spring-loaded lever 109 which urges the outer end 108 to rotate downwardly. A third pair of arms 110 are rotatably mounted in frame side plates 50 and 51, and have the outward ends 111 thereof inclined for contact with the interior surface of plate members 112 and 113 respectively. The illustrated plate 112 comprises the arm portion of the start lever 114 and is connected to the second plate 113 by a shaft 115. The inner ends 116 of arms 110 extend to engage the ends 108 of the positioning arm 104 and 105. In the attitude illustrated in FIG. 11, the wire positioner assembly is in an open position whereby the plate 113 is in an upwardly disposed position and is not engaging the inclined surface of the lever 110. The springloaded lever 109 impinges upon the outer end of the arm 104 and pivots the same downwardly to rotate the tip 106 away from the crimping jaw assembly. In FIG. 12, the wire positioner assembly is in an operating position wherein the start lever 114 has been pushed downwardly by the user to initiate the crimping cycle. The plate 112 engages the outer end 111 of arm 110 thereby applying a counterclockwise moment to the positioner arm 105, overcoming the resilient force of the springloaded lever 109. The projecting tip 106 of the assembly is thereby rotated downwardly between the uppermost side portions of the sleeve and pushes the wire segments 2 between the protuberances 18 of the sleeve to insure engagement therewith.

The wire cutter assembly 123 is best illustrated in FIGS. 13 and 14, and includes a frame 124, which is mounted in the rearward portion of the crimping jaw carriage 79 and is vertically slidable therein. The frame 124 comprises depending legs 125 and 126, and a connecting top member 127. The top member 127 has a pair of V-shaped grooves 128 which lead to vertical slots 129 positioned therethrough in an aligned relationship with the connector sleeves and crimping jaws. A cutter blade 130 is mounted slidably in the frame 124 and includes a pair of sharpened edges 131 positioned adjacent to the slots 129 and adapted for transverse, horizontal cutting action. An outer end 132 of the cutter blade 130 is inclined and shaped to mate with the similarly inclined edge of a vertical bar member 133 which is slidingly mounted within the wire cutter frame 124. In the attitude illustrated in FIG. 13, the upwardly motion of the bar 133 forces the cutter blade 130 to the left thereby urging the cutting edges 131 through the wires, which are held in place in frame slots 129. A return spring 134 and a return spring bracket 135 urge the cutter blade 130 in a direction toward the right to an open position.

A C-shaped bracket 136 (FIG. 13) is connected with the leg 125 of the cutter assembly frame adjacent the end thereof and includes upper and lower projecting ears 137 and 138 respectively. A pin 139 projects rearwardly from the crimping cam 64 and engages the upper ear 137 during the upstroke to pull the wire cutter assembly upwardly, and engages the lower ear 138 on the downstroke thereof to pull the same to its return position. A hook shaped arm 140 is pivotally attached to the vertically slidable, cutter blade bar 133 and includes upper and lower engaging surfaces 141 and 142 respectively. A second pin 143 projects rearwardly from the crimping jaw cam 64, and the arm 140 is resiliently urged into engagement with the pin by a hair spring 144.

A springloaded pawl assembly 145 engages the leg 125 of the wire cutter assembly 123 and holds the entire wire cutting frame 124 in a stationary position with repect to the apparatus frame 4 during the wire cutting operation. A stop pin 146 extends inwardly through frame side plate 51 and is attached to the upper, free end of a hinged arm 147. A second hinged arm 148 underlaps the first arm 147, is retained in position by a leaf spring 149, and includes a projecting pin 150 extending laterally from a medial portion thereof. A bracket 151 is attached to the lower portion of the crimping cam 64 and includes an inclined cam surface 152 adapted to engage the pin 150. In the start position, stop pin 146 engages bracket 136 and attached frame leg 125 and prevents upward movement of the frame 124. As the crimping cam 64 moves upwardly during the power cylinder's upstroke, the pin 143 and upper arm surface 141 are engaged thereby elevating the vertically slidable cam bar 133, forcing the cutter blade 130 through the wires 2 and severing the same. After the cutter blade edges 131 have passed through the wires, the lower engaging surface 142 of the lever 140 hits a pin 153 which projects from the frame leg 126, and creates a moment acting on the lever arm 140 in a clockwise orientation. This motion forces the upper surface 141 of the lever arm to disengage the pin 143. The cutter blade is then returned by spring member 134 to its open position. The upwardly translating bracket 151 engages pin 150 and rotates the arm 148 in a clockwise manner (as viewed in FIG. 13). The rotation of arm 148 imparts counterclockwise rotational motion to arm 147 thereby withdrawing the top pin 146 from bracket 136 and unlocking the wire cutter frame for vertical translation. Contemporaneously with the disengagement of stop pin 146, the cam pin 139 hits the upper bracket ear 137 and bodily translates the entire wire cutter assembly 123 upwardly.

Figure 15:
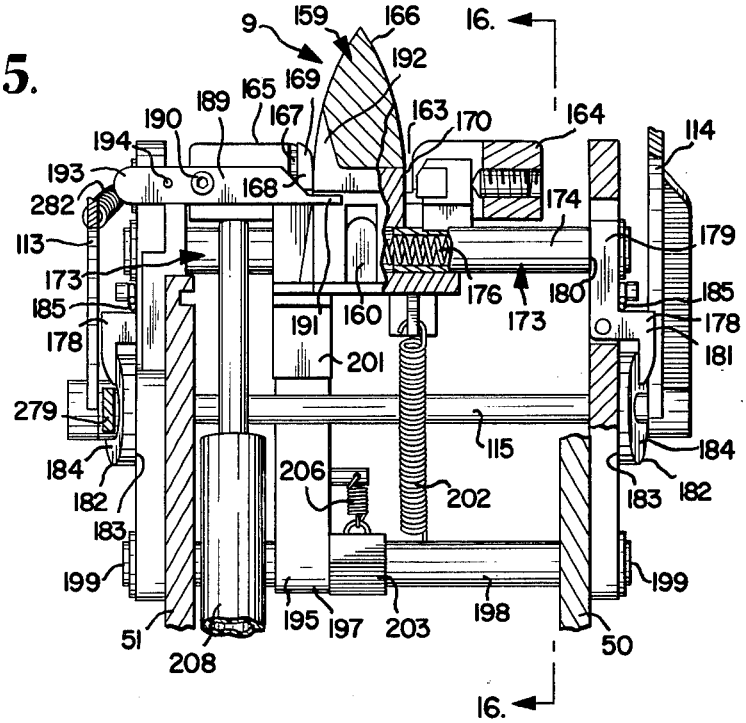
FIG. 15 is a fragmentary vertical cross-sectional view of the apparatus taken along the line 15—15, FIG. 6, and particularly showing a wire ejector assembly.
Figure 16:
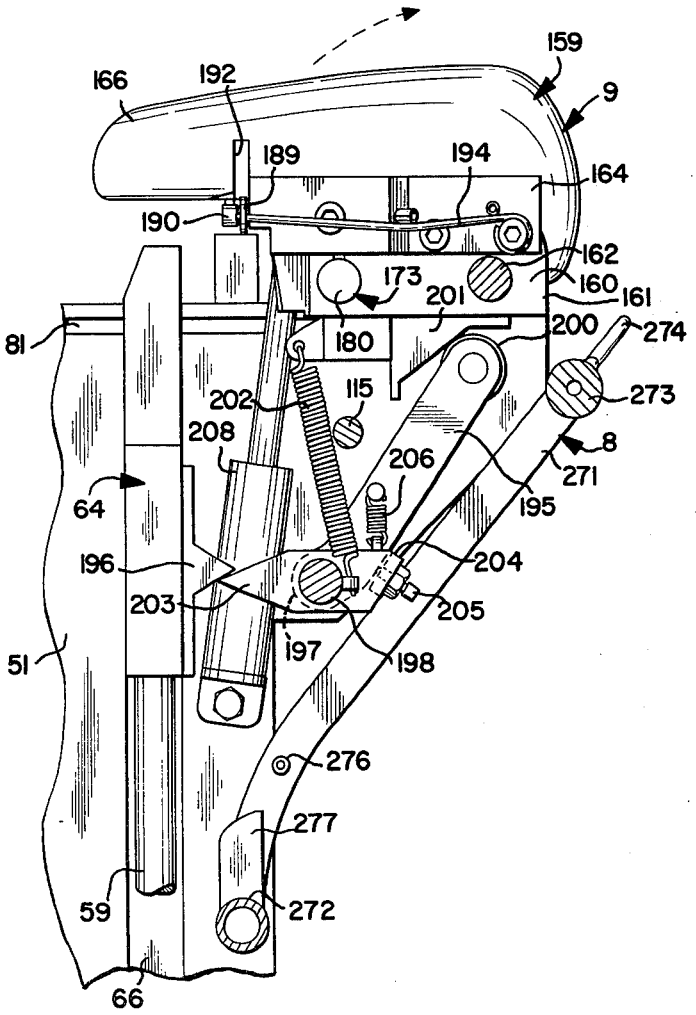
FIG. 16 is a vertical cross-sectional view of the ejector assembly taken along the line 16—16, FIG. 15.
Figure 17:
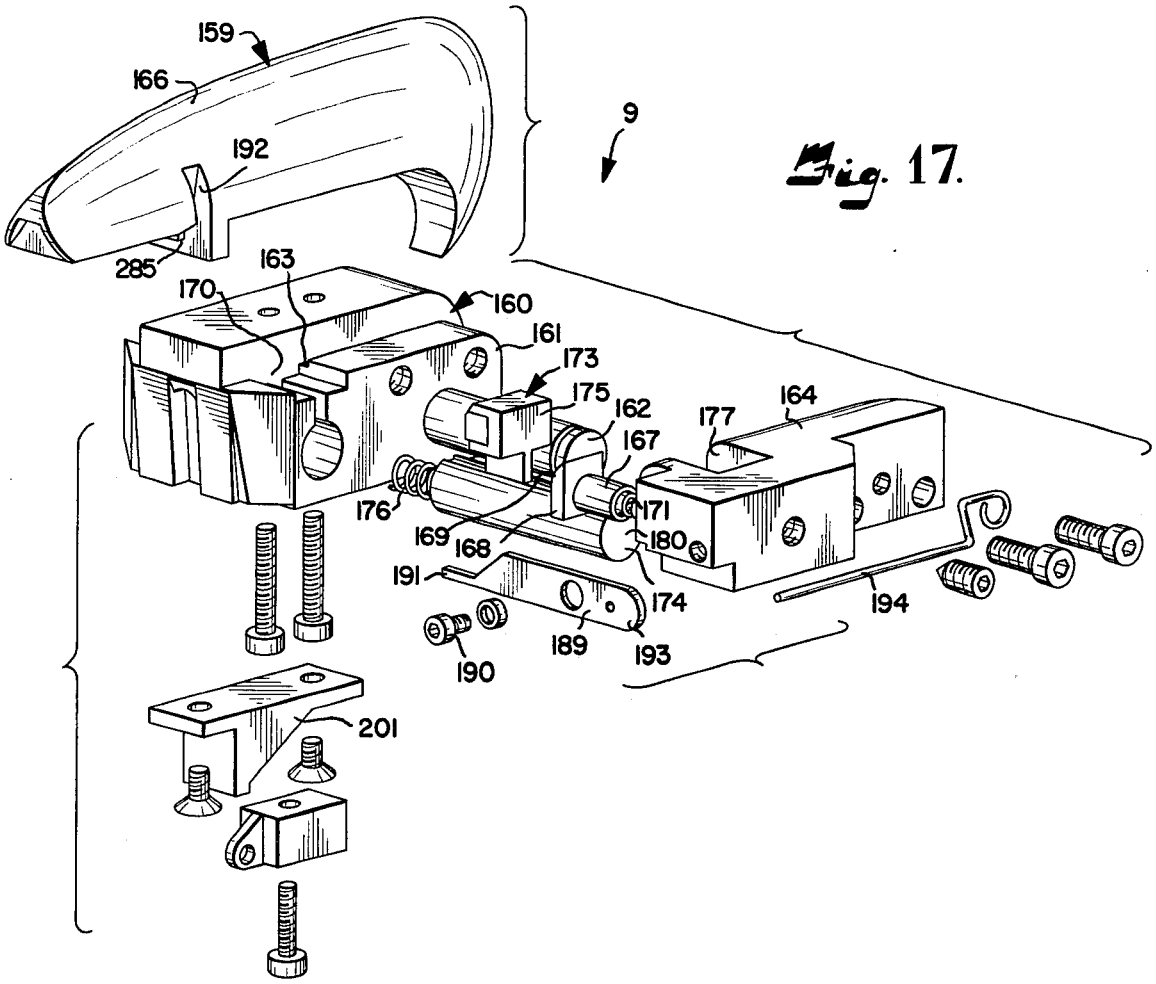
FIG. 17 is an exploded perspective view of the wire ejector assembly.

The wire clamp and ejector assembly 159, as illustrated in FIGS. 15, 16, and 17, includes a central body member 160 (FIG. 12) positioned between the frame side plates 50 and 51, and is pivotally connected therewith at the forward end 161 of the central member by a transverse shaft 162. The central body member 160 is disposed forwardly of the crimping jaws 6 and includes two side members 164 and 165 respectively, attached to a different side of the central member. A pair of parallel, spaced apart slots 163 (FIG. 15) are formed between the central and side members, 160, and 164 and 165 respectively, for receiving and retaining the wire 2 therein, and the side members 164 and 165 are transversely apertured for slidably mounting wire clamping members therein. A wire guide 166 having a substantially parabolically shaped transverse cross section, and a smooth exterior contour is connected with the upper surface of the central member 160, and facilitates placement of the wires into the slots 163.

A pair of first wire clamps each comprises a tubular member 167 (FIG. 17) and a face member 168 attached perpendicularly thereto. The face member 168 has a rounded upper edge 169 to facilitate the insertion of the wires between the face member and the interior side 170 of the slot 163. A coil spring 171 has one end thereof positioned within the tubular member 167 and the other end connected with the associated side member 164 or 165, and continuously urges the face member 168 against the interior slot side 170, frictionally retaining the wire thereinbetween. A second pair of wire clamps 173 are retractable, and each includes a tubular base 174, and upstanding wire engaging member 175, and a coil spring 176 which urges the second wire clamp outwardly, away from the inner side 170 of the slot. Each of the second wire clamps 173 is slidably mounted in an apertured portion 177 of one of the side members 164 and 165. As best illustrated in FIG. 15, a pair of lever arms 178 are provided to operate the clamp 173, each having an upper end 179 thereof in abutting contact with the outward end 180 of the second wire clamp base 174, and a medial portion thereof pivotally mounted in the frame side plates 50 and 51. The other end of each lever arm 178 includes an L-shaped portion 181 which slidingly mates with a rotating cam member 182. Each of the cams 182 is circular and includes a flat face 183 abutting the exterior side of the frame side plates and a second, inclined surface 184 oriented at an angle to the flat face. In this example, a pair of hair springs 185 (FIG. 4) urge the arms 178 into sliding contact with the cams 182. The cams 182 are attached to the ends of shaft 115 (FIG. 15) which is mechanically rotated by the user when he depresses the start lever. The start lever 114 is depressed to initiate the splicing operation, thereby rotating cams 182. Rotation of the cam pivots the upper end 179 of each lever arm 178 inwardly, thereby forcing each of the second clamps 173 against the wires and frictionally retaining the same against the inner face 170 of the slots. When the start lever returns upwardly to its initial position, the springs 176 force the second wire clamps 173 open and allow the spliced wires with crimped sleeve thereon to be ejected from the crimping jaws.

A pair of ejector arms 189 (FIG. 17) are pivotally attached by screws 190 to the side members 164 and 165. Each of the ejector arms 189 includes an inwardly projecting portion 191 which extends inwardly of and beneath the wire slots 163. The wire guide 166 is provided with a pair of apertures 192 which allow the arm ends 191 to extend inwardly beyond the wire slots 163. The outer end 193 of each ejector arm has resilient means, such as a hairpin spring 194 urging the same downwardly.

Means are provided for pivoting the clamping and ejector assembly about shaft 162, and the embodiment illustrated in FIG. 16 comprises a lever arm 195 having the lower end 197 thereof fixidly attached to a shaft 198 with the ends 199 of the shaft rotatably mounted in the left and right hand frame side plates 50 and 51 respectively. The upper end of the lever arm 195 includes a roller 200 mounted therein which is held in abutting contact with an inclined bracket 201 by a coil spring 202. The bracket 201 is attached to the bottom of the ejector assembly 159. A wedge-shaped member 203 is rotatably mounted on the shaft 198 and positioned laterally thereon adjacent the lever arm 195. An end portion 204 of the wedge 203 projects laterally therefrom and includes adjustment means such as a bolt 205 which engages the forward surface of the lever arm 195. On the power piston downstroke, a catch 196 mounted on the crimping cam 64 engages the wedge member 203 which in turn impinges upon arm 195 and pivots the ejector assembly 159 upwardly in the direction of the arrow (FIG. 16) about shaft 162. The manipulation of adjustment means 205 controls the moment in the operation cycle that the ejector assembly shall be pivoted, as well as how high the same will be raised. As the ejector assembly 159 is pivoted upwardly, the outer ends of the ejector arms 189 are urged downwardly against frame side plates 50 and 51 by springs 194, and the inward ends 191 of the arms are rotated upwardly away from wire slots 163 and out from wire guide apertures 192. Inner ejector arm ends 191 abut the spliced wires at a point adjacent the crimped sleeve and pull the wires and sleeve thereon upwardly and forwardly out from between the crimping jaw members 89 and 90. A pair of V-shaped grooves (not shown) are provided at the forward edge of the jaw assembly to facilitate sleeve ejection. When the catch 196 passes by the wedge 203 disengaging the same, the coil spring 202 returns the ejector assembly 159 to its initial, substantially horizontal position. A damper 208 such as an air cylinder, is provided to control the returning pivoting motion of the ejector assembly and prevent the same from impacting the butt splicer device with destructive speed and force. On the power piston upstroke, the catch 196 engages the wedge 203 and rotates the same freely on the shaft 198 in a clockwise direction (FIG. 16), leaving the ejector assembly 159 in a stationary condition. Spring 206 returns the wedge member 203 to an abutting position with the arm 195.

The sleeve feed assembly 7 is best illustrated in FIGS. 20 and 21 and comprises a central plate 216 slidably mounted by H-shaped bracket 217 between the frame side plates 50 and 51 at a rearward portion thereof. A pair of reel shafts 218 project from each side of the plate 216 at a lower portion thereof and are adapted for receiving and retaining spools 219 (FIGS. 4 and 5) thereon which store coiled chains of connector sleeves 2. Each chain is payed from the spool 219 through a tubular guide 220 into a cutter and injector mechanism 221. The sleeve chain is initially engaged by a first, springloaded pawl assembly 222 which includes an arm 223 projecting inwardly to the connector sleeves and engaging the same at the tab portion 20 thereof between adjacent sleeves (FIG. 8), and prevents the sleeves from moving in a backwardly direction. A second or drive pawl device 224 is slidably mounted on slotted plates 225 and pushes the chain into the sleeve cutter assembly. The second pawl 224 includes a spring loaded catch 226 which engages the sleeve chain at the tab, and is translated forwardly and rearwardly with respect to the frame side plates 50 and 51 by a springloaded lever arm mechanism 227.

Figure 18:
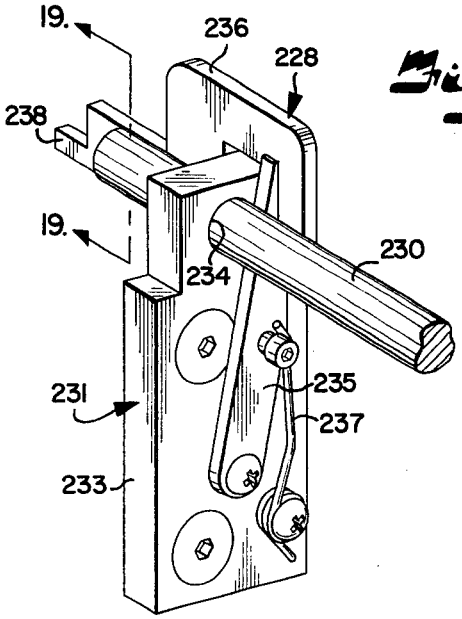
FIG. 18 is an enlarged perspective view of a trigger device for the sleeve feed assembly.
Figure 19:
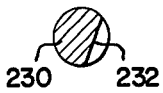
FIG. 19 is a transverse cross-sectional view of a cocking rod member of the trigger device, taken along line 19—19 of FIG. 18 and showing a notch.

A trigger mechanism actuates the drive pawl 224 for properly timing the injection of the sleeves into the crimping jaws. The mechanism 228 is illustrated in FIGS. 18 and 20, and comprises a drive arm 229 which connects the sliding drive pawl assembly 224 with lever arm 227 and transmits motion therebetween, a cocking rod 230, and a release assembly 231. The cocking rod 230 has its rearward end connected with lever arm 227 and includes a notch 232 (see FIG. 19) adjacent the other end thereof. The illustrated release assembly 231 (FIG. 18) includes a housing block 233 attached to the H-shaped bracket 217 with a transverse aperture 234 therethrough which slidingly receives the forward end of rod 230 therein. A pivot arm 235 having a C-shaped extension 236 rigidly attached thereto is rotatably connected with the housing block 233 and includes a hair spring 237. The arm mates with the notch 232 in rod 230 and selectively restrains translation therebetween. The projecting end 238 of the arm extension 236 is connected with a sliding key 239, which is best illustrated in FIGS. 4 and 6, is actuated by a hinged arm 240. The actuator arm 240 is attached to the side of the crimping cam 64, translates therewith, and is urged against the outer surface of frame side 50 by a leaf spring 241. The upper end of the arm 240 includes a projection 242 which selectively engages a pin 243 projecting from key 239. The key 239 slides inwardly and outwardly of the frame thereby rotating trigger arm 235, and is urged in a normally inward position by a spring 244.

As the crimping cam moves upwardly, projection 242 abuts pin 243 and is forced by an inclined surface thereof outwardly over the pin whereby the arm continues its upward motion. On the return stroke, a second inclined surface of the projection 242 engages the pin 243 and pulls the key outwardly thereby rotating trigger arm 235 and disengaging the same from cocking rod notch 232. This allows the lever arm 227 to spring forwardly whereby the drive pawl assembly 224 injects the chain into the sleeve cutter assembly, as well as pushes a severed sleeve into the crimping jaws. The illustrated structure includes a bracket and coil spring mechanism 247 connected between the central plate 216 and the sliding pawl assembly 224 to assist the return spring 266 and insure proper injection timing. A damper 245 controls the speed of sleeve injection to prevent jaming the device.

The cutting assembly 246 is best illustrated in FIG. 21 and includes a blade member 248 attached to an L-shaped arm 249 mounted slidably to the H-shaped bracket 217. The lower end of the arm 249 extends downwardly from an anti-friction mounting unit 250, and in this example, is cylindrically shaped and mates with an apertured portion of a lever mechanism 251. A spring 252 urges the cutter blade arm 249 toward a normally upward position. As the sleeve feed assembly 7 translates downwardly with respect to the butt splicer frame, the outer end 253 of lever 251 engages inwardly projecting pin 254 (FIG. 5) whereby the lever is rotated, and the blade is drawn downwardly through the sleeve tab thereby severing the adjacent connector sleeve therefrom.

Actuator means is provided for the sleeve cutter, and the actuator illustrated in FIG. 4 comprises a pin 256 threadedly attached to the sleeve feed, H-shaped bracket 217 which projects outwardly of a slot 257 in the frame side plate 50. An arm 258 is attached to the side edge of the crimping cam 64 through a second slot 259, and extends beyond the first slot 257. When the crimping cam moves upwardly, the arm 258 engages pin 256 and bodily translates the entire sleeve feed assembly 7 upwardly within the frame. At the top of the stroke, pin 256 is locked in its uppermost position by a springloaded catch 260. When arm 258 moves downwardly, the bottom edge thereof impinges upon a release lever 261 which disengages the pin 256 from catch 260 causing the sleeve feed assembly to fall rapidly downwardly within the frame slides, thereby providing sufficient momentum to cut the sleeve chains. After the sleeve cutter blade 248 has reciprocated on the cylinder downstroke, a single, unattached sleeve is disposed on each side of the cutter assembly awaiting injection into its associated crimping jaw. After the crimped sleeves are ejected, the drive pawl assembly 224 moves the sleeve chain forwardly such that the end of the next sleeve to be cut abuts the adjacent end of the unattached sleeve and forces the latter into the crimping jaws. A stop 285 (FIG. 17) depending from the wire guide 166 positions the injected sleeve longitudinally between the crimping jaws. Apertures 286 (FIG. 14) are provided through the wire cutter frame 124 to facilitate the transfer of the cut sleeves from the sleeve cutter assembly to the crimping jaws.

A cocking mechanism 263 for the drive arm 227 and drive pawl assembly 224, is best illustrated in FIG. 5, and is rotatably attached to he sleeve feed plate 216. A lever member 264 engages a roller 265 connected to the butt splicer frame, and rotates the mechanism, thereby elongating a pair of springs 266, and rotating the drive arm 227 rearwardly. Means are provided for positively engaging the sleeve feed assembly and pulling the same downwardly, and in this example includes a projecting drive member 267 (FIG. 9) which extends from the rear surface of the crimping cam 64 and engages the upper surface of a pivotally mounted bracket 268. A spring member (not shown) urges the bracket 268 outwardly to engage the drive member 267, and as the sleeve feed assembly 7 reaches its lowermost position, abutting contact between grooved plate 269 and the bracket 268 pivots the same inwardly disengaging it from the crimping cam.

The wire tensioning device 8 is illustrated in FIGS. 4 and 16 and includes a pair of forwardly projecting arms 271 having the lower ends thereof pivotally mounted between the frame side walls 50 and 51 by a shaft 272. The upper ends of the arms 271 are connected by rod member 273 having curved extensions 274 projecting upwardly and outwardly therefrom to retain the wires therebetween. A spring 275 (FIG. 4) urges the wire tensioning arms 271 toward the ejector assembly against a stop pin 276. As the crimping cam moves downwardly, to its operational start position, the bracket 196 engages a rounded arm 277 fixedly attached to the medial portion of the shaft 272 and rotates the wire tensioning device forwardly away from the ejector assembly and crimping jaws.

In operation, the operator preferably stands adjacent to that side of the butt splicer apparatus with the start lever 114 projecting therefrom. The operator matches at least two pairs or sets of wires to be spliced, and pulls the same over the wire tensioning rod 273 and downwardly into the wire clamp slots 163 between the side walls 16 of the sleeves disposed in the crimping jaws. The face portion 168 of the first wire clamps frictionally hold the wires in the slots. The wire tensioning assembly is in an extended position, spaced forwardly of the device. The operator then pulls rearwardly on the wires making them taut between the support arm 37 and his point of grip thereon. The start lever 114 is then depressed by the operator thereby mechanically activating the wire clamp and positioner assemblies 159 and 103 respectively whereby the wires are frictionally engaged with the central body member 160 of the ejector and positioned between the sleeve protuberances 18. Near the bottom of the start lever's stroke, an arm 279 (FIG. 5) trips an electric solenoid switch 280 which controls the supply of hydraulic pressure to the lower side of the piston and forces the cylinder upwardly to begin the stroke. Means such as a ball catch 281 (FIG. 12) holds the start lever 114 in the depressed position against the resilient forces of return spring 282 (FIG. 5). The ends of the wires are trimmed to length by the wire cutter assembly 123. Since the operator is now grasping the offal portion of the wire which has been severed, he may easily dispose of the same in a convenient manner. The rearward faces 70 and 74 of the crimping cam then engage the crimping carriage 79 and translate the same longitudinally of and with respect to the wires such that the newly trimmed wire ends are disposed wholly within the associated sleeve. Because the wires are retained in a taut, clamped position with respect to the carriage over the wire tensioning arm, there is relative motion between the sleeve and wire. The jaw leaf springs 99 retain the sleeves between the jaws 89 and 90 to insure this relative motion. The crimping cam then engages the crimping jaws and converges each pair thereof, thereby connecting the wires and sleeve for electrical conduction. The direction of the hydraulic pressure is then automatically reversed when arm 240 abutts start lever 114 disengaging it from catch 281, and the crimping cam is pulled downwardly allowing the crimping jaws to open and releasing the crimped sleeves disposed therebetween. The ejector assembly 159 then pivots upwardly whereby the ejector arms 189 engage the spliced wires adjacent the forwardly end of the sleeve and pull the same upwardly and forwardly out of the jaws and clear of the apparatus. Another sleeve is automatically fed into each crimping jaw by the sleeve feed assembly 7. Two additional sleeves are cut from the chain as the crimping cam moves downwardly, and the crimping carriage moves to its forwardmost position. The butt splicer is now in a condition to splice additional wires.

It is to be understood that while I have illustrated and described certain forms of my invention, it is not to be limited to the specific forms or arrangement of parts herein described and shown.

What I claim and desire to secure by Letters Patent is:

1. An apparatus for trimming end portions of first and second wires and butt splicing the same together by crimping an open sided electrical connecting sleeve onto trimmed wire ends, said apparatus comprising:

(a) a frame;

(b) means on said frame defining a sleeve receiving position and shaped for receiving a sleeve therein;

(c) means positioning said first and second wires longitudinally into said sleeve with the untrimmed free ends of said wires extending outwardly of one end of the sleeve;

(d) cutting means mounted on said frame adjacent to said sleeve receiving position and being operable to trim each wire free end to a predetermined point relative to said sleeve;

(e) crimping members mounted on said frame and having portions thereof movable toward and away from each other at said sleeve receiving position for crimping the sleeve about the wires disposed therein;

(f) means selectively translating said sleeve in a longitudinal direction and with respect to said wires for positioning each of the trimmed wire ends within the sleeve and; and (g) activator means connected with said frame and operative to, in sequence, activate the cutting means for trimming the wires; activate said means for longitudinal translation of said sleeve with respect to said wires whereby said trimmed wire ends are disposed wholly within said sleeve; move said crimping member portions together to a fully crimped position wherein said wires are physically and electrically connected; and retract said crimping member portions for removing said sleeve and wires therefrom.

2. An apparatus as set forth in claim 1 wherein:

(a) said relative translation means comprises means for engaging said sleeve and translating the same longitudinally of and with respect to said trimmed wire ends.

3. An apparatus as set forth in claim 2 including:

(a) injector means automatically inserting a non-crimped sleeve between said crimping members; and (b) ejector means automatically removing said first and second wires and the sleeve crimped thereon from inbetween said crimping members.

4. An apparatus as set forth in claim 3 including:

(a) wire positioner means retaining said wires between opposing side walls of said sleeve during sleeve crimping positions; and (b) wire tensioning means for engaging said wires and restraining the same from motion relative to said frame during longitudinal translation.

5. An apparatus as set forth in claim 2 wherein:

(a) said sleeve engaging and translating means includes a crimping carriage mounted slidably within said frame and translating transversely therein; and (b) said crimping members are mounted laterally within said crimping carriage.

6. A method for butt splicing first and second communication cables comprising the steps of:

(a) moving an open sided electrical connector sleeve to a receiving position between crimping members;

(b) selecting a matched wire from each of said cables and positioning the same longitudinally in a trimming position between opposing side walls of said sleeve with untrimmed free ends of the wire extending outwardly of one end of the sleeve;

(c) trimming said wires by cutting the untrimmed free end portions thereof at a predetermined point disposed adjacent to said sleeve receiving position;

(d) translating said crimping members and said sleeve longitudinally of and with respect to said wires to a sleeve crimping position, and retaining said wires in said trimming position, whereby each trimmed wire end is positioned wholly within said sleeve;

(e) converging said crimping members and thereby crimping said sleeve on said matched wires and electrically connecting the same; and (f) retracting said crimping members and removing said sleeve and connected wires from said receiving position. /

7. A method as set forth in claim 5 wherein:

(a) two of said connector sleeves are moved to respective receiving positions in substantially side by side relation with each positioned between respective crimping members; and (b) four wires which are matched pairs from each cable are selected, held and trimmed and matched pairs are moved to and deposited in a respective connector sleeve and the crimping members moved to simultaneously crimp the connector sleeves and electrically connect the respective matched pairs of wires.

8. A method as set forth in claim 5 wherein:

(a) said sleeves are automatically injected between said respective crimping members; and (b) said matched wires and sleeves crimped thereon are automatically ejected from between said respective crimping members.

9. An apparatus for trimming end portions of first and second wires and butt splicing the same together by crimping an open sided electrical connecting sleeve onto trimmed wire ends, said apparatus comprising:

(a) a frame;

(b) means on said frame defining a sleeve receiving position;

(c) cutting means mounted on said frame adjacent to said sleeve receiving position and being operable to trim each wire free end to a predetermined point relative to said;

(d) crimping members mounted on said frame and having portions thereof movable toward and away from each other at said sleeve receiving position for crimping a sleeve about wires disposed therein;

(e) means for relative translation between said sleeve and said wires in a divergent and longitudinal direction;

(f) activator means connected with said frame and operative to, in sequence, activate the cutting means for trimming the wires; activate said means for relative translation between said sleeve and said wires whereby said trimmed wire ends are disposed wholly within said sleeve; move said crimping member portions together to a fully crimped position wherein said wires are physically and electrically connected; and retract said crimping member portions for removing said sleeve and wires therefrom; and wherein (g) said relative translation means comprises means for engaging said sleeve and translating the same longitudinally of and with respect to said trimmed wire ends, and includes a crimping carriage mounted slidably within said frame and translating transversely therein; and (h) said crimping members are mounted laterally within said crimping carriage.

10. An apparatus as set forth in claim 8 wherein:

(a) said actuator means includes a vertically reciprocating cam engaging said crimping carriage and translating the same in said frame.

11. An apparatus as set forth in claim 8 including:

(a) a reciprocating cam having a first face thereof disposed transversely of said frame, engaging said crimping members, and converging the same for crimping said sleeve onto said trimmed wire ends; and wherein (b) said sleeve longitudinal translating means includes a second face of said cam disposed substantially perpendicularly of said first face, engaging said crimping carriage and translating the same longitudinally of and with respect to said frame for positioning said trimmed wire ends wholly within said sleeve.

12. An apparatus as set forth in claim 10 wherein:

(a) said crimping means portions include first and second pairs of opposed, laterally acting jaws; each pair of jaws having resilient means for engaging a sleeve side wall and retaining the sleeve between said jaws during longitudinal translation; and (b) said cam includes a fork with first and second terminal prongs and a medial prong; each of said prongs having said first and second faces positioned adjacent to an upper end thereof and engaging said crimping carriage and said jaws respectively.

13. An apparatus as set forth in claim 8 wherein:

(a) said cutting means is connected with said crimping carriage for longitudinal movement therewith.

14. An apparatus as set forth in claim 2 including:

(a) wire tensioning means for engaging said first and second wires and restraining the same from motion relative to said frame during longitudinal sleeve translation.

15. An apparatus as set forth in claim 2 including:

(a) ejector means automatically removing said first and second wires and said sleeve crimped thereon from inbetween said crimping members.

16. An apparatus as set forth in claim 2 including:

(a) injector means automatically inserting a non-crimped sleeve between said crimping members after a crimped sleeve and associated wires are ejected therefrom.

17. An apparatus as set forth in claim 15 wherein:

(a) said sleeve is interconnected to a plurality of like sleeves to form a chain thereof; and including (b) means severing said sleeve from said chain.

18. An apparatus as set forth in claim 2 including:

(a) wire positioner means retaining said wires between opposing side walls of said sleeve during sleeve crimping positions.

19. An apparatus as set forth in claim 2 wherein:

(a) said actuator means includes a double acting hydraulic cylinder, hydraulic pressure supply means, and switching means operably connected with said supply means.

20. An apparatus for trimming end portions of first and second wires and butt splicing the same together by crimping an open sided electrical connecting sleeve onto trimmed wire ends, said apparatus comprising:

(a) a frame;

(b) means on said frame defining a sleeve receiving position;

(c) cutting means mounted on said frame adjacent to said sleeve receiving position and being operable to trim each wire free end to a predetermined point relative to said sleeve;

(d) crimping members mounted on said frame and having portions thereof movable toward and away from each other at said sleeve receiving position for crimping a sleeve about wires disposed therein;

(e) means for relative translation between said sleeve and said wires in a divergent and longitudinal direction;

(f) activator means connected with said frame and operative to, in sequence, activate the cutting means for trimming the wires; activate said means for relative translation between said sleeve and said wires whereby said trimmed wire ends are disposed wholly within said sleeve; move said crimping member portions together to a fully crimped position wherein said wires are physically and electrically connected; and retract said crimping member portions for removing said sleeve and wires therefrom;

(g) ejector means automatically removing said first and second wires and said sleeve crimped thereon from inbetween said crimping members, and including:

(1) a central body pivotally mounted at a forward end thereof in said frame and being positioned adjacent to and forwardly of said crimping members;

(2) wire clamp means disposed in said central body and frictionally and separably connecting said wires with said central body; and (3) means selectively pivoting said central body; and wherein (h) said relative translation means comprises means for engaging said sleeve and translating the same longitudinally of and with respect to said trimmed wire ends.

21. An apparatus as set forth in claim 19 including:

(a) spring loaded ejector arms pivotally attached to said central member and having inner ends thereof for abuttingly engaging said wires after crimping and ejecting the same from said crimping members.

22. An apparatus for trimming end portions of first and second wires and butt splicing the same together by crimping an open sided electrical connecting sleeve onto trimmed wire ends, said apparatus comprising:

(a) a frame;

(b) means on said frame defining a sleeve receiving position;

(c) cutting means mounted on said frame adjacent to said sleeve receiving position and being operable to trim each wire free end to a predetermined point relative to said sleeve;

(d) crimping members mounted on said frame and having portions thereof movable toward and away from each other at said sleeve receiving position for crimping a sleeve about wires disposed therein;

(e) means for relative translation between said sleeve and said wires in a divergent and longitudinal direction;

(f) activator means connected with said frame and operative to, in sequence, activate the cutting means for trimming the wires; activate said means for relative translation between said sleeve and said wires whereby said trimmed wire ends are disposed wholly within said sleeve; move said crimping member portions together to a fully crimped position wherein said wires are physically and electrically connected; and retract said crimping member portions for removing said sleeve and wires therefrom;

(g) wire tensioning means for engaging said first and second wires and restraining the same from motion relative to said frame during longitudinal sleeve translation, and including:

(1) an arm having a first end thereof pivotally connected with a forward portion of said frame;

(2) a bar connected with a second end of said arm and extending transversely thereof; said bar being adapted to abuttingly engage said wires; and (3) means selectively pivoting said arm forwardly for stretching said wires over said bar during a starting position, and rearwardly for creating slack in said wires during an ejecting position; and wherein (h) said relative translation means comprises means for engaging said sleeve and translating the same longitudinally of and with respect to said trimmed wire ends.

23. An apparatus for trimming end portions of first and second wires and butt splicing the same together by crimping an open sided electrical connecting sleeve onto trimmed wire ends, said apparatus comprising:

(a) a frame;

(b) means on said frame defining a sleeve receiving position;

(c) cutting means mounted on said frame adjacent to said sleeve receiving position and being operable to trim each wire free end to a predetermined point relative to said sleeve;

(d) crimping members mounted on said frame and having portions thereof movable toward and away from each other at said sleeve receiving position for crimping a sleeve about wires disposed therein;

(e) means for relative translation between said sleeve and said wires in a divergent and longitudinal direction;

(f) activator means connected with said frame and operative to, in sequence, activate the cutting means for trimming the wires; activate said means for relative translation between said sleeve and said wires thereby said trimmed wire ends are disposed wholly within said sleeve; move said crimping member portions together to a fully crimped position wherein said wires are physically and electrically connected; and retract said crimping member portions for removing said sleeve and wires therefrom;

(g) a clamping arm connected with said frame and normally stationary relative thereto for connecting said wires therewith and stretching an end segment of said wires taut between said clamping arm and said cutting means;

(h) wire tensioning means for engaging the end segment of each wire and selectively slackening the same for sleeve ejection; and wherein (i) said relative translation means comprises means for engaging said sleeve and translating the same longitudinally of and with respect to said trimmed wire ends.

24. An apparatus for trimming end portions of first and second wires and butt splicing the same together by crimping an open sided electrical connecting sleeve onto trimmed wire ends, said apparatus comprising:

(a) a frame;

(b) means on said frame defining a sleeve receiving position;

(c) cutting means mounted on said frame adjacent to said sleeve receiving position and being operable to trim each wire free end to a predetermined point relative to said sleeve;

(d) crimping members mounted on said frame and having portions thereof movable toward and away from each other at said sleeve receiving position for crimping a sleeve about wires disposed therein;

(e) means for relative translation between said sleeve and said wires in a divergent and longitudinal direction;

(f) activator means connected with said frame and operative to, in sequence, activate the cutting means for trimming the wires; activate said means for relative translation between said sleeve and said wires whereby said trimmed wire ends are disposed wholly within said sleeve; move said crimping member portions together to a fully crimped position wherein said wires are physically and electrically connected; and retract said crimping member portions for removing said sleeve and wires therefrom;

(g) a vertically adjustable stand having a clamping arm for connecting said wires therewith and stretching said wires taut between said arm and said cutting means; and wherein (h) said relative translation means comprises means for engaging said sleeve and translating the same longitudinally of and with respect to said trimmed wire ends.

* * * * *